US005554232A

United States Patent [19]

Fujimoto et al.

[11] Patent Number: 5,554,232

[45] Date of Patent: Sep. 10, 1996

[54] AMORPHOUS METAL WIRE

[75] Inventors: Katsuyuki Fujimoto; Kohati Nomura; Shuji Ueno, all of Kyoto, Japan

[73] Assignee: Unitika Ltd., Hyogo, Japan

[21] Appl. No.: 333,989

[22] Filed: Nov. 2, 1994

[30] Foreign Application Priority Data

Nov. 2, 1993 [JP] Japan ..... 5-297293

[51] Int. Cl.[6] ..... H01F 1/153

[52] U.S. Cl. ..... 148/304; 148/403; 148/442; 420/581

[58] Field of Search ..... 148/304, 403, 148/442; 420/581

[56] References Cited

U.S. PATENT DOCUMENTS 4,743,313 5/1988 Makino et al. ..... 148/403

4,806,179 2/1989 Hagiwara et al. ..... 148/403

*Primary Examiner*—John Sheehan

*Attorney, Agent, or Firm*—Sughrue, Mion, Zinn, Macpeak & Seas

[57] ABSTRACT

An amorphous metal wire having the following composition by atomic %:

$$(Fe_aCo_b)_{100-(y+z)}Si_yB_z$$

where $0.4 \leqq a \leqq 0.6$, $a+b=1$, $6 \leqq y \leqq 8$, and $13 \leqq z \leqq 16$. The wire shows a Large Barkhausen effect and is excellent in pulse voltage generating properties and toughness. The amorphous metal wire according to the present invention is widely applicable to pulse voltage generating elements and various magnetic markers.

11 Claims, No Drawings

AMORPHOUS METAL WIRE

FIELD OF THE INVENTION

This invention relates to an amorphous metal wire having a Large Barkhausen effect, excellent magnetic properties and high toughness, the amorphous metal wire being useful as a pulse voltage generating element.

BACKGROUND OF THE INVENTION

It has been well known that amorphous metal materials having various forms (for example, thin film band, filament, powder) and various properties can be obtained by quenching molten metals. In particular, Fe- and Co-based filamentous quenched amorphous metal wires having a circular cross-section which are disclosed in JP-A-1-25941 (U.S. Pat. No. 4,735,864) and JP-A-1-25932 (U.S. Pat. No. 4,781,771), are known as magnetic materials showing a Large Barkhausen effect. These materials undergo a rapid magnetic flux change at a certain applied magnetic field value during magnetization. (The term "JP-A" as used herein means an "unexamined published Japanese patent application".) These amorphous metal wires have been widely used as magnetic markers and magnetic cores of pulse voltage generating elements.

Further, JP-A-63-24003 discloses an Fe-based amorphous metal wire having a wire diameter of 100 μm or less and showing a Large Barkhausen effect that can be obtained by the steps of drawing an Fe-based quenched amorphous metal wire, heating under tension and then quenching.

Examples of amorphous metal wires, other than those described above, include an amorphous metal wire having excellent fatigue characteristics [see JP-A-58-213857 (U.S. Pat. No. 4,473,401)], an amorphous metal wire having excellent fatigue characteristics and toughness [see JP-A-60-106949 (U.S. Pat. No. 4,584,034)] and an amorphous metal wire having excellent fatigue characteristics and improved toughness [see JP-A-63-145742 (U.S. Pat. No. 4,806,179)]. These amorphous metal wires are widely employed in industrial materials, such as various reinforcements, by taking advantage of the excellent mechanical properties thereof.

Attempts are made to develop an amorphous metal wire useful as a pulse voltage generating element using the above-mentioned amorphous metal wires by the method proposed in JP-A-63-24003. However, the use of these amorphous metal wires for this purpose is disadvantageous because, for example, they each either have poor magnetic properties or will break frequently during the cold drawing or heat treatment step due to insufficient toughness of the amorphous metal wire.

SUMMARY OF THE INVENTION

It is an object of the present invention to provide an amorphous metal wire showing a Large Barkhausen effect and excellent pulse voltage generating properties such that it is useful as a pulse voltage generating element, the wire having high toughness in order to facilitate wire-drawing and heating under tension following the wire-drawing process.

This object, and other objects of the present invention have been achieved by an amorphous metal wire having the following composition by atomic %:

$$(Fe_aCo_b)_{100-(y+z)}Si_yB_z$$

where $0.4 \leqq a \leqq 0.6$, $a+b=1$, $6 \leqq y \leqq 8$, and $13 \leqq z \leqq 16$;

the wire showing a Large Barkhausen effect and excellent pulse voltage generating properties and toughness.

Because of the wire composition as specified above, the amorphous metal wire of the present invention shows a Large Barkhausen effect, is excellent in pulse voltage generating properties and toughness and is widely applicable to pulse voltage generating elements and various magnetic markers.

DETAILED DESCRIPTION OF THE INVENTION

The present invention will now be described in greater detail.

In order to obtain an amorphous metal wire showing a Large Barkhausen effect, excellent pulse voltage generating properties and toughness, the alloy composition of the amorphous metal wire of the present invention should be as follows.

Namely, the Si content of the amorphous metal wire of the present invention should range from 6 to 8 atomic %, preferably from 6.5 to 8 atomic %. When the Si content is less than 6 atomic % or exceeds 8 atomic %, the resulting amorphous metal wire becomes brittle and is not satisfactory in terms of drawability. Thus, it cannot be used in practice.

The B content of the amorphous metal wire of the present invention should range from 13 to 16 atomic %, preferably from 13 to 15 atomic %. When the B content is less than 13 atomic % or exceeds 16 atomic %, the resulting amorphous metal wire becomes brittle and is not satisfactory in terms of drawability. Thus, it cannot be used in practice.

In the present invention, Fe and Co are used to obtain an amorphous metal wire having excellent magnetic properties due to a Large Barkhausen effect and high toughness. The total content of Si, B, Fe and Co should be 100 atomic %.

In order to achieve excellent pulse voltage generating properties based on the Large Barkhausen effect, the ratio of Fe in the total content of Fe and Co should range from 40 to 60%. It is particularly preferable that the ratio of Fe is from 45 to 55%. When the ratio of Fe in the total content of Fe and Co is less than 40% or exceeds 60%, only a low pulse voltage is generated on a detecting coil and the magnetic properties are poor, though a Large Barkhausen effect is observed.

The amorphous metal wire of the present invention can be obtained by melting an alloy of the above-mentioned composition and then quenching the same. The quenching may be carried out using any suitable method. Preferably, the quenching is a so-called "In-rotating-water spinning method" as described in JP-A-56-165016 (U.S. Pat. No. 4,523,626) or JP-A-57-79052 (U.S. Pat. No. 4,527,614). In this method, a cooling liquid is introduced into a rotary drum and a cooling liquid film is formed on the inner wall of the drum by centrifugal force. Then a molten alloy having the composition specified above is injected into the cooling liquid film from a spinning nozzle to thereby quench the same.

To obtain a continuous wire having a high degree of roundness and a little unevenness in wire diameter, it is preferable to adjust the peripheral velocity of the rotary drum to exceed the velocity of the stream of the molten metal injected from the spinning nozzle by about 5 to about 30% and to adjust the angle between the stream of the molten metal being injected from the spinning nozzle and the cooling liquid film formed on the inner wall of the drum to about 20° to about 70°.

The orifice size (diameter) of the spinning nozzle preferably ranges from about 50 to about 350 μm, more preferably from about 80 to about 220 μm. When the orifice size is less than 50 μm, there is difficult in injecting the molten metal from the nozzle, which makes it difficult to obtain a quenched wire material. When the orifice size of the spinning nozzle exceeds 350 μm, on the other hand, there is a tendency for the resulting metal wire to have poor qualities, i.e., a low degree of roundness and serious unevenness in wire diameter.

The amorphous metal wire of the present invention can be also produced by a so-called "conveyor method" described in JP-A-58-173059 (U.S. Pat. No. 4,607,683). In this method, a molten metal is injected from a spinning nozzle and thus placed in contact with a cooling liquid layer formed on a running, grooved conveyor belt to thereby quench the same.

To obtain a continuous wire having a high degree of roundness and a little unevenness in wire diameter, it is preferable to adjust the speed of the cooling liquid layer running on the conveyor to at least about 300 m/min and to control the ratio of the speed of the cooling liquid layer running on the conveyor to the velocity of the stream of the molten metal flow to a range of about 1 to about 1.3. It is also preferable to adjust the angle between the molten metal being injected from the spinning nozzle to the stream of the cooling liquid layer running on the conveyor to be not smaller than 30° and to make the orifice size of the spinning nozzle not more than 350 μm.

Being highly tough, the amorphous metal wire of the present invention can be continuously cold-drawn without causing breaks by a conventional metal wire-drawing process and thus an amorphous metal wire having a desired wire diameter can be obtained. In the wire-drawing processing, the sectional area of the amorphous metal wire of the present invention can be reduced by 5 to 15% per die. By using a number of dies, the wire can be drawn until the desired wire diameter is achieved.

As disclosed in JP-A-63-24003, an amorphous metal wire, which shows a Large Barkhausen effect, excellent pulse voltage generating properties and a desired wire diameter, can be obtained by heating the wire under tension after the completion of the wire-drawing processing. This treatment is preferably performed under a tension of from 30 to 200 kg/mm$^2$ at a temperature of 300° to 580° C. for 0.05 to 300 sec.

When heat-treated under tension after the wire-drawing in accordance with, for example, the above-discussed conventional technique, the amorphous metal wire of the present invention shows a Large Barkhausen effect of a residual magnetic flux density of about 14,000 to 15,000 G (gauss), a ratio of residual magnetic flux density to saturation magnetic flux density of 0.9 to 1 and the critical magnetic field of domain nucleation for flux reversal of 0.1 to 10 Oe (oersted).

The amorphous metal wire according to the present invention has a diameter of about 50 to 350 μm and is uniform in shape with a roundness of at least about 60%, preferably at least 80%, more preferably at least 90%, and an unevenness in wire diameter of about 8% or below, more preferably about 3% or below.

The roundness of the metal wire was evaluated in term of the ratio of $R_{max}$ to $R_{min}$ shown by the following equation, wherein $R_{max}$ is the diameter across the longest axis and $R_{min}$ is the diameter across the shortest axis for the same cross section, in accordance with a test method as described in U.S. Pat. Nos. 4,523,626 and 4,527,614.

$$\text{roundness (\%)} = \frac{R_{min}}{R_{max}} \times 100$$

The unevenness in wire diameter in the longitudinal direction was evaluated on the basis of the diameter measurement at 10 randomly selected points in a 10 m long portion of the specimen. The difference between the maximum and minimum diameters was divided by the average diameter and the quotient was multiplied by 100, and taken as the unevenness in wire diameter.

The metal wire of the present invention is substantially amorphous. Thus, it may contain a crystalline phase to such a degree that its magnetic properties and toughness are not deteriorated thereby, i.e., less than 15% by volume based on the total volume of the metal wire, which is determined by the X-ray diffraction method.

The present invention is described in greater detail in the following Examples and Comparative Examples which are set forth by way of illustration only and not by way of limitation.

EXAMPLES 1 TO 5 AND COMPARATIVE EXAMPLES 1 to 6

Each of the alloys with the various compositions listed in Table 1 was melted in a quartz tube under an argon atmosphere. Using a quartz spinning nozzle of 125 μm orifice size, the molten metal was quenched by injection at an argon gas injection pressure of 4.4 kg/cm$^2$ into a film of cooling water (4° C. in temperature, 2.5 cm in depth) which had been formed in a cylindrical drum (inner diameter: 500 mm) rotating at about 280 to 350 rpm. Thus, 500 m of a continuous quenched amorphous metal wire of each composition was produced.

In the above-mentioned process, the distance between the spinning nozzle and the surface of the rotating cooling liquid was 1 mm or less and the angle between the stream of the molten metal injected from the spinning nozzle and the rotating cooling liquid was 45°. The average wire diameter of each of the quenched wires thus obtained are shown in Table 1. Each quenched wire is uniform in shape with a roundness of about 92% and an unevenness in wire diameter of about 3%. The amorphous phase was judged on the basis of the formation of a halo pattern which is characteristic to amorphous substances by the X-ray diffractometry.

Next, each of the quenched wires was passed successively through diamond dies of 135, 130, 125, 120, 115, 110, 105 and 100 μm. After cold wire-drawing, wires of 100 μm in wire diameter were obtained. The number of breaks occurring during the wire-drawing process were counted to thereby evaluate the toughness of each composition. The number of breaks per 100 m which occurred in the drawing process of each wire material is shown in Table 1.

Further, the cold-drawn wire of each composition having a wire diameter of 100 μm was heated at a temperature of 390° C. under a tension of 140 kg/mm$^2$ for 1 minute. Thus, an amorphous metal wire showing a Large Barkhausen effect (about 0.20 Oe in the critical magnetic field of domain nucleation for flux reversal) was obtained in each case. Subsequently, a sample (20 cm in length) of each amorphous metal wire was magnetized with a triangular wave field of a frequency of 50 Hz and a maximum applied magnetic field of 1 Oe. Then, the pulse voltage thus generated was measured with a detecting coil (3.5 cm in length, 590 turns, 3 cm in inner diameter) wound around the amorphous metal wire. The pulse voltage generated by each amorphous metal wire is shown in Table 1.

TABLE 1

| Example | Composition (atomic %) Fe | Co | Si | B | Average wire diameter of quenched wire (μm) | Number of breaks in drawing process (per 100 m) | Pulse voltage (mV) |
|---|---|---|---|---|---|---|---|
| Ex. 1 | 39 a = 0.5 | 39 b = 0.5 | 7 | 15 | 122 | 0 | 108 |
| Ex. 2 | 35 a = 0.45 | 43 b = 0.55 | 7 | 15 | 122 | 0 | 103 |
| Ex. 3 | 43 a = 0.55 | 35 b = 0.45 | 7 | 15 | 123 | 1 | 100 |
| Comp. Ex. 1 | 28 a = 0.36 | 50 b = 0.64 | 7 | 15 | 123 | 12 | 85 |
| Comp. Ex. 2 | 50 a = 0.64 | 28 b = 0.36 | 7 | 15 | 122 | 13 | 82 |
| Ex. 4 | 39 a = 0.5 | 39 b = 0.5 | 8 | 14 | 122 | 0 | 103 |
| Ex. 5 | 39.5 a = 0.5 | 39.5 b = 0.5 | 6 | 15 | 123 | 1 | 101 |
| Comp. Ex. 3 | 39 a = 0.5 | 39 b = 0.5 | 9 | 13 | 122 | 35 | 98 |
| Comp. Ex. 4 | 39.5 a = 0.5 | 39.5 b = 0.5 | 5.5 | 15.5 | 123 | 268 | 98 |
| Comp. Ex. 5 | 37.5 a = 0.5 | 37.5 b = 0.5 | 8 | 17 | 123 | 56 | 97 |
| Comp. Ex. 6 | 40 a = 0.5 | 40 a = 0.5 | 8 | 12 | 122 | 200 | 95 |

As the results given in Table 1 clearly show, the amorphous metal wires of Comparative Examples 1 and 2, in which the content of Fe and Co were outside the ranges of the present invention, generated low pulse voltages in the detecting coil and had low toughness, though they were amorphous metal wires showing a Large Barkhausen effect.

Also, the amorphous metal wires of Comparative Examples 3 to 6, in which the content of Si or B was outside the ranges of the present invention, do not have sufficient toughness and frequently suffered from breaks in the drawing process. Therefore, these wires cannot be used as an industrial material.

In contrast, the amorphous metal wires of Examples 1 to 5 each showed a Large Barkhausen effect, generated a high pulse voltage of 100 mV or above and caused almost no breaks because of its high toughness.

While the invention has been described in detail and with reference to specific examples thereof, it will be apparent to one skilled in the art that various changes and modifications can be made therein without departing from the spirit and scope thereof.

What is claimed is:

1. An amorphous metal wire consisting essentially of Fe, Co, Si and B, and having the following composition by atomic %:

$$(Fe_aCo_b)_{100-(y+z)}Si_yB_z$$

where:

$0.4 \leqq a \leqq 0.6$;

$a+b=1$;

$6 \leqq y \leqq 8$; and $13 \leqq z \leqq 16$.

2. The amorphous metal wire of claim 1, wherein the wire shows a Large Barkhausen effect.

3. The amorphous metal wire of claim 1, wherein the wire has excellent toughness.

4. The amorphous metal wire of claim 1, wherein the wire generates a high pulse voltage.

5. The amorphous metal wire of claim 1, wherein $6.5 \leqq y \leqq 8$.

6. The amorphous metal wire of claim 1, wherein $13 \leqq z \leqq 15$.

7. The amorphous metal wire of claim 1, wherein $0.45 \leqq a \leqq 0.55$.

8. The amorphous metal wire of claim 1, wherein the wire has a roundness of at least 60%.

9. The amorphous metal wire of claim 8, wherein the wire has a roundness of at least 80%.

10. The amorphous metal wire of claim 9, wherein the wire has a roundness of at least 90%.

11. The amorphous metal wire of claim 1, wherein the wire has an unevenness in wire diameter of 6% or below.

* * * * *